US008409072B2

(12) United States Patent
Matsubara et al.

(10) Patent No.: US 8,409,072 B2
(45) Date of Patent: Apr. 2, 2013

(54) INFANT CARE APPARATUS

(75) Inventors: Terumi Matsubara, Tokyo (JP); Eiji Koike, Saitama (JP); Masato Honda, Saitama (JP); Tomochi Kira, Chiba (JP); Yutaka Sekiguchi, Saitama (JP); Kazuo Matsubara, Tokyo (JP)

(73) Assignee: Atom Medical Corporation, Tokyo (JP)

( * ) Notice: Subject to any disclaimer, the term of this patent is extended or adjusted under 35 U.S.C. 154(b) by 405 days.

(21) Appl. No.: 12/465,426

(22) Filed: May 13, 2009

(65) Prior Publication Data

US 2010/0081859 A1 Apr. 1, 2010

(30) Foreign Application Priority Data

Oct. 1, 2008 (JP) ..... 2008-256547

(51) Int. Cl.
*A61G 11/00* (2006.01)

(52) U.S. Cl. ..... 600/22; 600/21

(58) Field of Classification Search ..... 600/21, 600/22; 392/407, 411–415, 419, 421–428; 128/202.12

See application file for complete search history.

(56) References Cited

U.S. PATENT DOCUMENTS 4,463,749 A * 8/1984 Sobczak et al. ..... 126/605
5,474,517 A 12/1995 Falk et al.
5,761,377 A * 6/1998 Wolfe et al. ..... 392/376
5,841,944 A * 11/1998 Hutchinson et al. ..... 392/418
6,245,010 B1 6/2001 Jones
6,393,211 B1 * 5/2002 Jolan et al. ..... 392/423
6,447,442 B1 * 9/2002 Richards et al. ..... 600/22
6,502,963 B1 * 1/2003 King ..... 362/297
7,282,022 B2 10/2007 Falk et al.
2003/0198052 A1 * 10/2003 Witkowski ..... 362/297
2005/0070756 A1 * 3/2005 Falk et al. ..... 600/22
2005/0124850 A1 * 6/2005 Mackin ..... 600/22
2010/0249492 A1 * 9/2010 Khodak ..... 600/22

OTHER PUBLICATIONS

"Infrared Basic Heating Information" InfraredHeaters. Dec. 6, 1998 (obtained via Wayback Machine).*

* cited by examiner

*Primary Examiner* — Navin Natnithithadha
*Assistant Examiner* — Meredith Weare
(74) *Attorney, Agent, or Firm* — Hunton & Williams LLP

(57) ABSTRACT

In an infant care apparatus according to this invention, the inner surface of an upper reflecting plate portion of a reflector forms a reflecting surface extending substantially parallel to the axial direction of a rod-like heat generator. A first angle at which a rear end of the reflecting surface as an end portion on a side opposite to the center of an infant mat, when seen from the top, of a direction perpendicular to the axial direction is bent downward with respect to a center in a back-and-forth direction of the reflecting surface, which is developed substantially flat, is larger than a second angle at which a front end of the reflecting surface as an end opposite to the rear end is bent downward with respect to the center of the reflecting surface. This invention can provide the infant care apparatus in which not only a heater need not be retracted to another location or need be only slightly when an infant on the mat is to undergo X-ray imaging of the like, but also in spite that the upper surface of the mat is substantially rectangular, the entire upper surface of the mat can be warmed substantially uniformly or almost uniformly.

20 Claims, 12 Drawing Sheets

INFANT CARE APPARATUS

TECHNICAL FIELD

The present invention relates to an infant care apparatus including a mat to lay an infant thereon, and a heater capable of radiating heat rays toward the upper surface of the mat, the heater including a substantially rod-like heat generator, and a reflector including an upper reflecting plate portion covering the rod-like heat generator substantially from above, and the reflecting plate portion including an inner surface that forms a reflecting surface extending substantially parallel to an axial direction of the rod-like heat generator.

BACKGROUND OF THE INVENTION

U.S. Pat. No. 6,245,010B1 (to be referred to as "the above prior patent reference" hereinafter) discloses an open type incubator (a so-called infant warmer) including an infant mat, which is substantially rectangular when seen from the top, to lay an infant such as an immature infant thereon, and a heater capable of radiating heat rays toward the upper surface of the mat. As the open type incubator of the above prior patent reference, the first example that uses a substantially rod-like heat generator and the second example that uses a substantially spherical heat generator are shown.

In the open type incubator as the first example of the above prior patent reference, the heater is arranged substantially right above the infant mat. As the length of the heater in the back-and-forth direction is substantially equal to that of the infant mat in the back-and-forth direction, the rod-like heat generator can warm the entire upper surface of the infant mat substantially uniformly. The open type incubator as the second example of the above prior patent reference includes a substantially spherical heat generator and a substantially hemispherical reflecting plate which covers substantially the upper surface of the heat generator from above. When seen from the top, the heater is arranged at a position sufficiently displaced from the center toward the head-side end of the upper surface of the infant mat. Thus, when, e.g., X-ray imaging an infant on the mat, the heater need not be retracted to another location.

In the open type incubator as the first example of the above prior patent reference, however, when, e.g., X-ray imaging an infant on the mat, the heater need be retract to another location. This retraction is cumbersome to perform, and renders the structure of the open type incubator complicated. Due to an erroneous operation or the like, the heater may accidentally come into contact with the X-ray imaging apparatus or the like, damaging both of them. Furthermore, since the head of a personnel attending to the infant on the mat may block the heat rays from the heater, the heater may not be able to exhibit its original performance sufficiently. Also, the head (particularly the back head part) of the attending personnel may be accidentally heated.

In the open type incubator as the second example of the above prior patent reference, since the upper surface of the mat is warmed using the substantially spherical heat generator and the substantially hemispherical reflecting plate, that round portion of the upper surface of the mat which is in a region including the center and its vicinity is warmed mainly. As the mat is substantially rectangular when seen from the top, the regions including the four corners of the upper surface of the mat and their vicinities are not warmed like the region including the center and its vicinity. Hence, when the infant is to undergo resuscitation or various types of other medical treatments or procedures, the infant must first be laid in the region including the center of the upper surface of the mat and its vicinity. This may impose restrictions on the treatments or procedures.

SUMMARY OF THE INVENTION

The present invention is to solve the drawbacks as described above of the infant care apparatus of the above prior patent reference with a comparatively simple arrangement.

It is, therefore, an object of the present invention to provide an infant care apparatus in which a heater can be arranged at a position displaced from the center of the upper surface of an infant mat to a certain degree, and accordingly when the infant on the mat is to undergo X-ray imaging or the like, the heater need not be retracted to another location or need be only slightly, and the head of the personnel attending to the infant on the mat is less likely to block heat rays from the heater, so that the heater can easily exhibit its original performance sufficiently and that the head (particularly the back head part) of the attending personnel is less likely to be accidentally heated.

It is another object of the present invention to provide an infant care apparatus in which, in spite that the upper surface of an infant mat is substantially rectangular, the entire upper surface of the mat can be warmed substantially uniformly or almost uniformly, so that when the infant is to undergo resuscitation or various types of other medical treatments or procedures, such medical treatments or procedures can be performed for the infant on whatever portion of the upper surface of the mat the infant may be laid.

It is still another object of the present invention to provide an infant care apparatus in which the shape of an upper reflecting surface portion will not easily deform by the warp or the like, so that a reflecting surface formed by the inner surface of the upper reflecting surface portion will not easily deform.

The present invention relates to an infant care apparatus including a mat to lay an infant such as an immature infant thereon, and a heater capable of radiating heat rays toward an upper surface of the mat, the heater including a substantially rod-like heat generator, and a reflector including an upper reflecting plate portion covering the rod-like heat generator substantially from above, and the upper reflecting plate portion including an inner surface that forms a reflecting surface extending substantially parallel to an axial direction of the rod-like heat generator, characterized in that the rod-like heat generator includes a center obliquely above a center of the upper surface of the mat, and a first angle at which a rear end of the reflecting surface as an end portion on a side opposite to the center of the mat, when seen from the top, of a direction perpendicular to the axial direction is bent downward with respect to a center in a back-and-forth direction of the reflecting surface, which is developed substantially flat, is larger than a second angle at which a front end of the reflecting surface as an end opposite to the rear end is bent downward with respect to the center of the reflecting surface. In this case, the infant care apparatus may be an open type incubator serving also as a closed type incubator, an open type incubator, an infant resuscitation apparatus, or any other infant care apparatus, but is preferably an open type incubator serving also as a closed type incubator. The upper surface of the mat may be substantially rectangular. Each of the mat and the heater can be supported by the common frame of the infant care apparatus directly or indirectly.

According to the present invention, the first angle may fall within a range of 50° to 115° (preferably 55° to 100° and more preferably 60° to 95°), the second angle may fall within a range of 20° to 45° (preferably 22.5° to 40° and more preferably 24° to 36°), a third angle at which the rear end of the reflecting surface is bent downward with respect to the front end of the reflecting surface may fall within a range of 70° to 160° (preferably 80° to 140° and more preferably 85° to 130°), and a fourth angle obtained by subtracting the second angle from the first angle may fall within a range of 30° to 70° (preferably 35° to 60° and more preferably 36° to 58°).

According to the present invention, preferably, the reflecting surface comprises a large number of substantially flat reflecting surface portions which extend longitudinally substantially along the axial direction of the rod-like heat generator, and the large number of longitudinal reflecting surface portions line up sequentially to be adjacent to each other in the back-and-forth direction of the reflecting surface. In this case, the number of large number of the longitudinal reflecting surface portions may fall within a range of 18 to 44 (preferably 21 to 39 and more preferably 24 to 36). Each of the large number of the longitudinal reflecting surface portions may have a width that falls within a range of 5.4 mm to 14.8 mm (preferably 6.0 mm to 13.2 mm and more preferably 6.4 mm to 12.4 mm) excluding the longitudinal reflecting surface portion located at an end portion of the reflecting surface in the back-and-forth direction. Furthermore, an angle formed by each of the longitudinal reflecting surface portions with one of the front and rear adjacent ones of the longitudinal reflecting surface portions may fall within a range of 0.5° to 13.5° (preferably 0.7° to 12° and more preferably 0.8° to 11.5°).

According to the present invention, a fifth angle formed by a line segment, connecting the center of the rod-like heat generator and the front end of the reflecting surface in the back-and-forth direction, when seen from the top, with the front end of the reflecting surface may fall within a range of 16° to 38° (preferably 18° to 34° and more preferably 20° to 30°), a sixth angle formed by a line segment, connecting the center of the rod-like heat generator and the rear end of the reflecting surface in the back-and-forth direction, when seen from the top, with the rear end of the reflecting surface may fall within a range of 20° to 45° (preferably 22.5° to 40° and more preferably 24° to 36°), and an angle obtained by subtracting the fifth angle from the sixth angle may fall within a range of 3.3° to 7.5° (preferably 3.75° to 6.67° and more preferably 4° to 6.25°). According to the present invention, preferably, a horizontal direction extending through the center of the rod-like heat generator and substantially perpendicular to the axial direction of the rod-like heat generator extends substantially through the center of the mat when seen from the top.

Furthermore, according to the present invention, preferably, degree of change of the angle at which the reflecting surface is bent downward with respect to the center of the reflecting surface from the center of the reflecting surface toward the front end of the reflecting surface decreases stepwise and/or continuously (more preferably stepwise) from the center of the reflecting surface toward the front end of the reflecting surface. Preferably, degree of change of the angle at which the reflecting surface is bent downward with respect to the center of the reflecting surface from the center of the reflecting surface toward the rear end of the reflecting surface increases stepwise and/or continuously (more preferably stepwise) until a midway portion, and decreases stepwise and/or continuously (more preferably stepwise) from the midway portion. According to the present invention, preferably, the heater at a heat ray radiation position is arranged outside the mat at a position spaced apart from a proximal-side end of the mat when seen from the top. In this case, when the heater is at the heat ray radiation position, a distance from the center of the rod-like heat generator to the center of the mat, when seen from the top, may fall within a range of 440 mm to 1,000 mm (preferably 500 mm to 880 mm and more preferably 530 mm to 830 mm).

The above, and other, objects, features and advantages of the present invention will become readily apparent from the following detailed description thereof which is to be read in connection with the accompanying drawings.

DETAILED DESCRIPTION OF THE INVENTION

One embodiment in which the present invention is applied to an open type incubator serving also as a closed type incubator will be described in "1. Schematic Arrangement of Incubator as a Whole", "2. Arrangement of Heater", "3. Arrangement of Upper Reflecting Plate Portion", "4. Function and Effect of Heater", "5. Modification" and "6. Preferred Arrangements as Infant Care Apparatus" with reference to the accompanying drawings.

1. Schematic Arrangement of Incubator as a Whole

Figure 1:
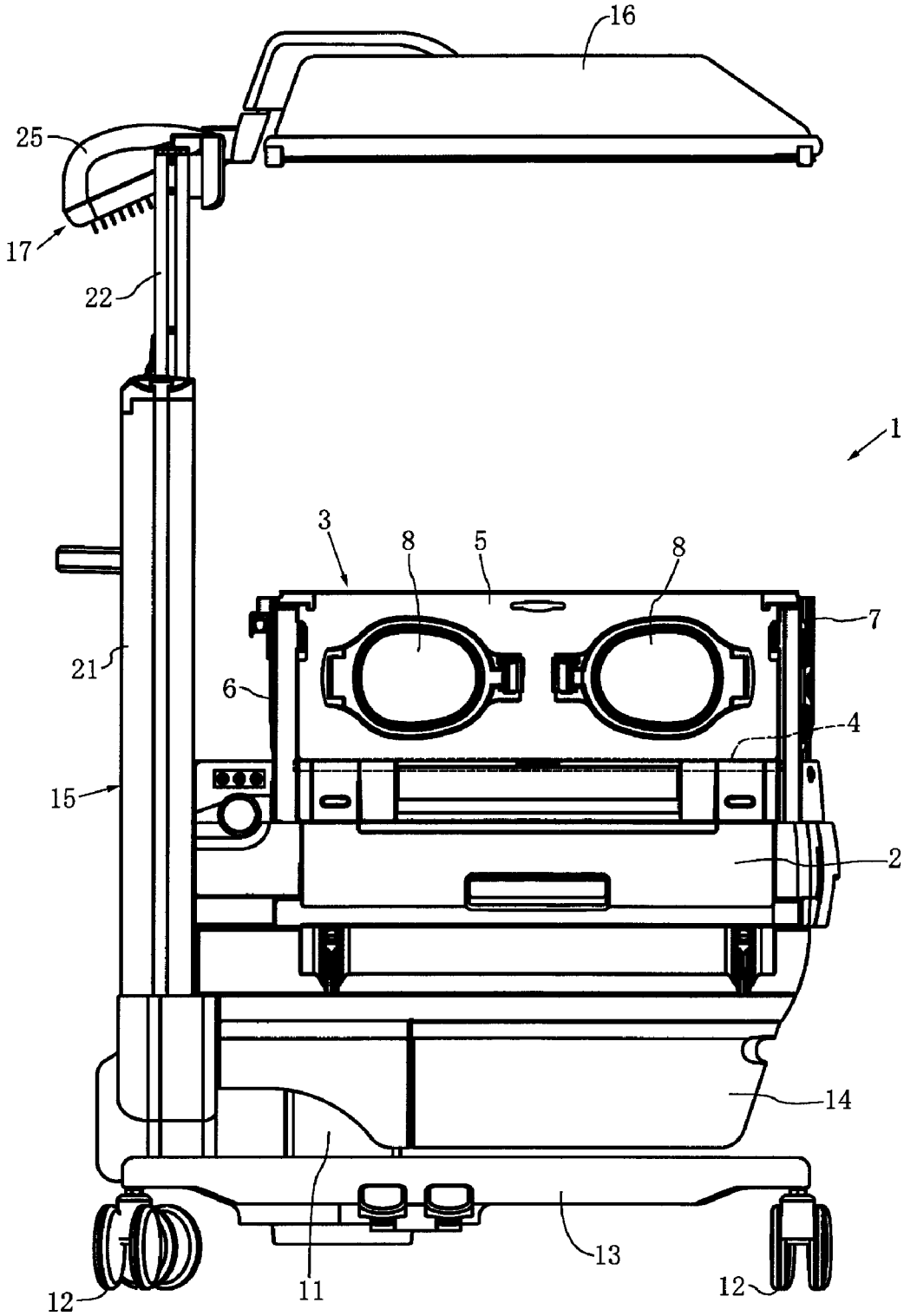
FIG. 1 is a right side view of an incubator, in an open type state, of an embodiment in which the present invention is applied to an open type incubator serving also as a closed type incubator.
Figure 2:
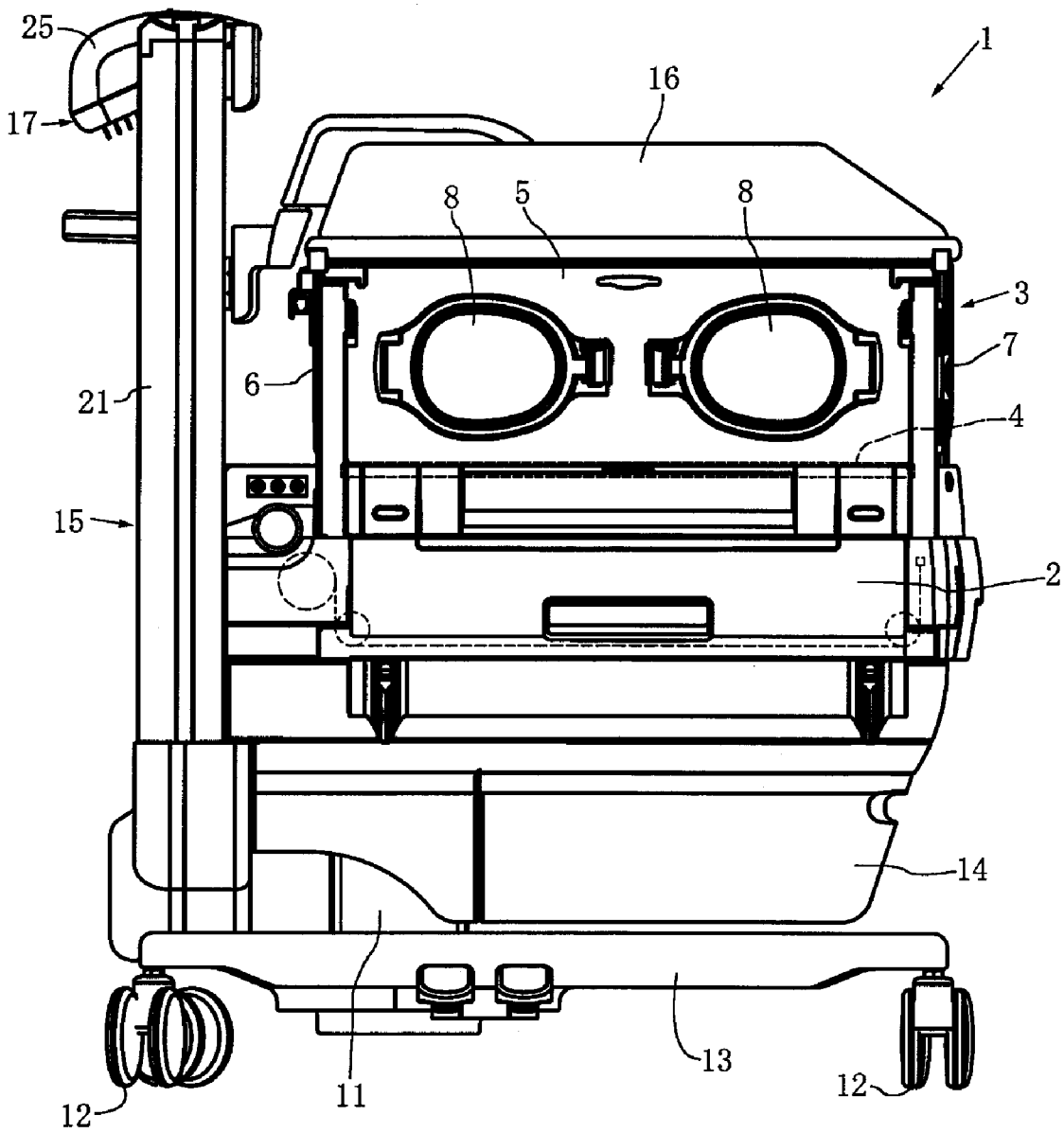
FIG. 2 is a right side view, similar to FIG. 1, of the incubator shown in FIG. 1 which is in a closed type state.

As shown in FIGS. 1 and 2, an incubator 1 includes a base 2 which is, e.g., substantially rectangular when seen from the top, and an enclosure 3 which is, e.g., substantially rectangular parallelopiped shape and stands along substantially the outer circumference of the base 2. A mattress tray (not shown) is arranged on the base 2. A thin sheet (not shown) is spread, if necessary, on an infant mat 4 disposed on the mattress tray, and then an infant such as an immature infant is laid on the sheet and undergoes a diagnosis or treatment, or is incubated.

The enclosure 3 may be substantially transparent as a whole, and includes a right wall 5, a left wall (not shown), a head-side (in other words, proximal-end-side) wall 6 and a leg-side (in other words, distal-end-side) wall 7. As each of the right wall 5, the left wall, the leg-side wall 7 and the like forms a fence or treatment window, it can be opened by moving downward or the like. This allows diagnosis, treatment, or the like for the infant to be performed from an arbitrary direction. Servicing windows 8 including a pair of front and rear servicing windows may be arranged in each of the right wall 5, the left wall and the like. When the right wall 5, the left wall and the leg-side wall 7 are completely opened, as described above, the incubator 1 can be used as a resuscitation apparatus.

The base 2 shown in FIGS. 1 and 2 is attached to and supported by a frame (not shown) extending substantially in the horizontal direction. A main strut 11 supports the frame. The main strut 11 is attached to and supported by a main base 13 having, e.g., four arms respectively having wheels 12. Furthermore, a drawer 14 that can be drawn out toward the leg side can be attached to the base 2.

A pair of left and right sub-struts 15 which may be symmetric with each other are attached to and supported by the frame attached to and supported by the main strut 11 shown in FIGS. 1 and 2. The pair of left and right sub-struts 15 are arranged outside the head-side wall 6 as they are spaced apart from the enclosure 3 toward the head side. The enclosure 3 further includes a top hood 16, as shown in FIGS. 1 and 2. The top hood 16 is attached to and supported by, for example, the right sub-strut 15 of the pair of left and right sub-struts 15. A heater 17 is attached to and supported by, e.g., the left sub-strut 15 so as to be located obliquely above the head side of a center 4*a* of the mat 4.

Each of the sub-strut 15 for the top hood 16 and the sub-strut 15 for the heater 17 shown in FIGS. 1 and 2 is formed of a stationary strut 21 and movable strut 22. The lower end portions of the stationary struts 21 of the pair of left and right sub-struts 15 are attached to and supported by the frame. Each movable strut 22 can be reciprocally driven (in other words, driven to be stretchable with respect to the corresponding stationary strut 21) in the substantially vertical direction by a driving mechanism such as a driven gear, driving chain, driving gear, and electric motor (neither is shown). When the top hood 16 moves to the upper position, as shown in FIG. 1, the incubator 1 serves as an open type incubator. When the top hood 16 moves to the lower position, as shown in FIG. 2, the incubator 1 serves as a closed type incubator. Assume that the incubator 1 serves as the closed type incubator. When the heater 17 is in an operable state, it may stay at the upper position, in the same manner as in the case shown in FIG. 1; when it is in a non-operable state, it may move the lower position shown in FIG. 2.

The arrangement and attaching position of the heater 17 will be described in detail in the next item and the following item (namely, "2. Arrangement of Heater" and "3. Arrangement of Upper Reflecting Plate portion"). Hence, a repeated detailed description on the arrangement and attaching position of the heater 17 will be omitted in this item. Basically, the arrangement of the incubator 1 may be a known one except for the arrangement and attaching position of the heater 17. As the arrangement of the incubator 1 in detail except for the arrangement and attaching position of the heater 17 is not the gist of the present invention, it will not be illustrated in detail or described in detail in the specification.

2. Arrangement of Heater

Figure 3:
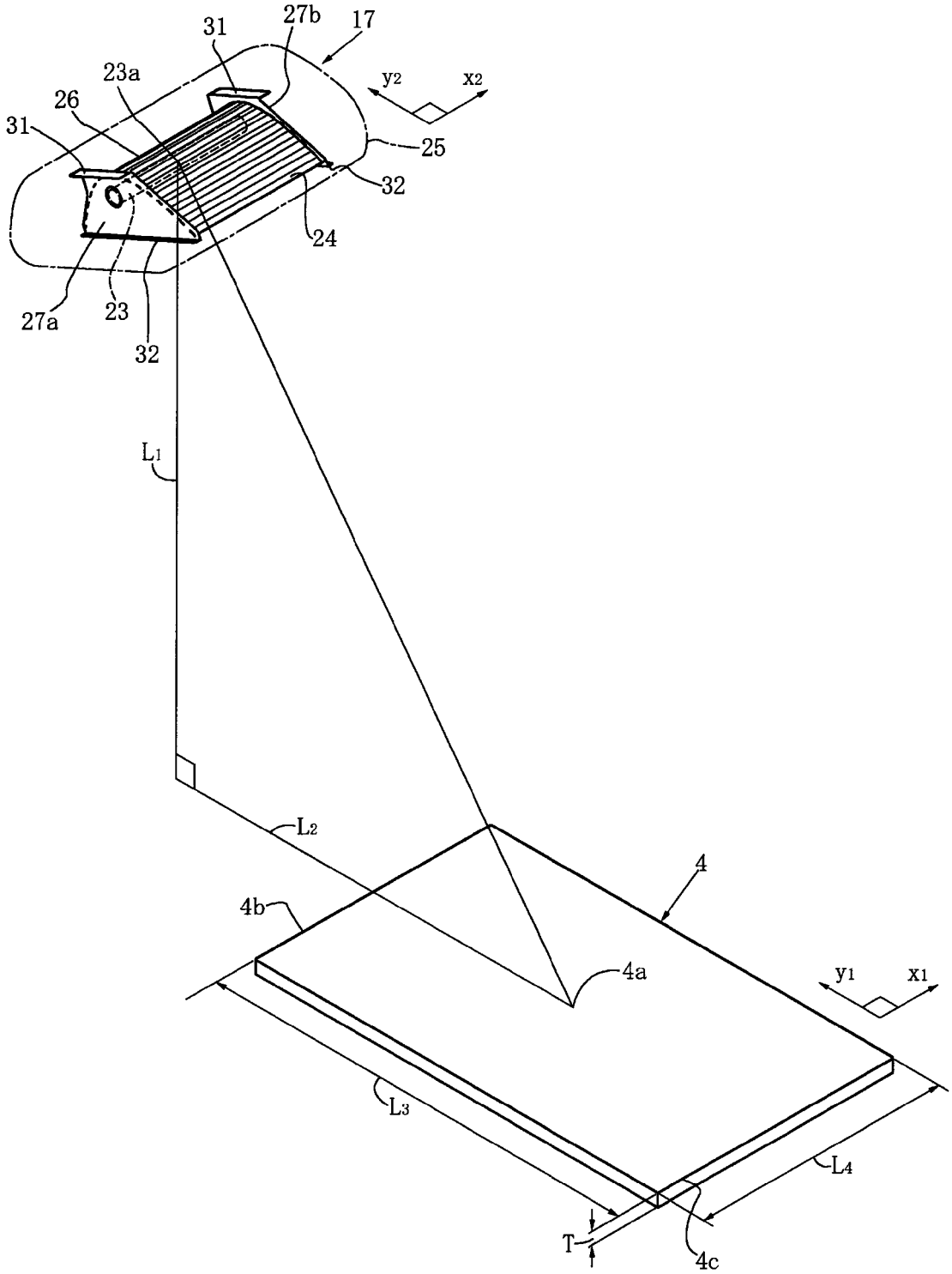
FIG. 3 is a schematic perspective view showing the positional relationship between a heater and mat in the incubator shown in FIG. 1.

As shown in FIG. 3, the heater 17 is formed of a substantially rod-like heat generator 23, reflector 24 and hood 25. As shown in FIGS. 1 and 2, the hood 25 is attached and fixed to a region including the upper end portion of the movable strut 22 of the heater sub-strut 15 and its vicinity. The rod-like heat generator 23 may be one obtained by covering a stainless steel pipe having a substantially tubular shape, e.g., a substantially cylindrical shape with a ceramic heat-generating element, or one obtained by accommodating a heat-generating element formed of a resistor coil wire such as a nichrome wire in a quarz tube having a substantially tubular shape, e.g., a substantially cylindrical shape. For example, the rod-like heat generator 23 may have a diameter of about 15 mm and a length of about 180 mm. The hood 25 may be a molded product made of a heat-resistant synthetic resin.

Figure 4:
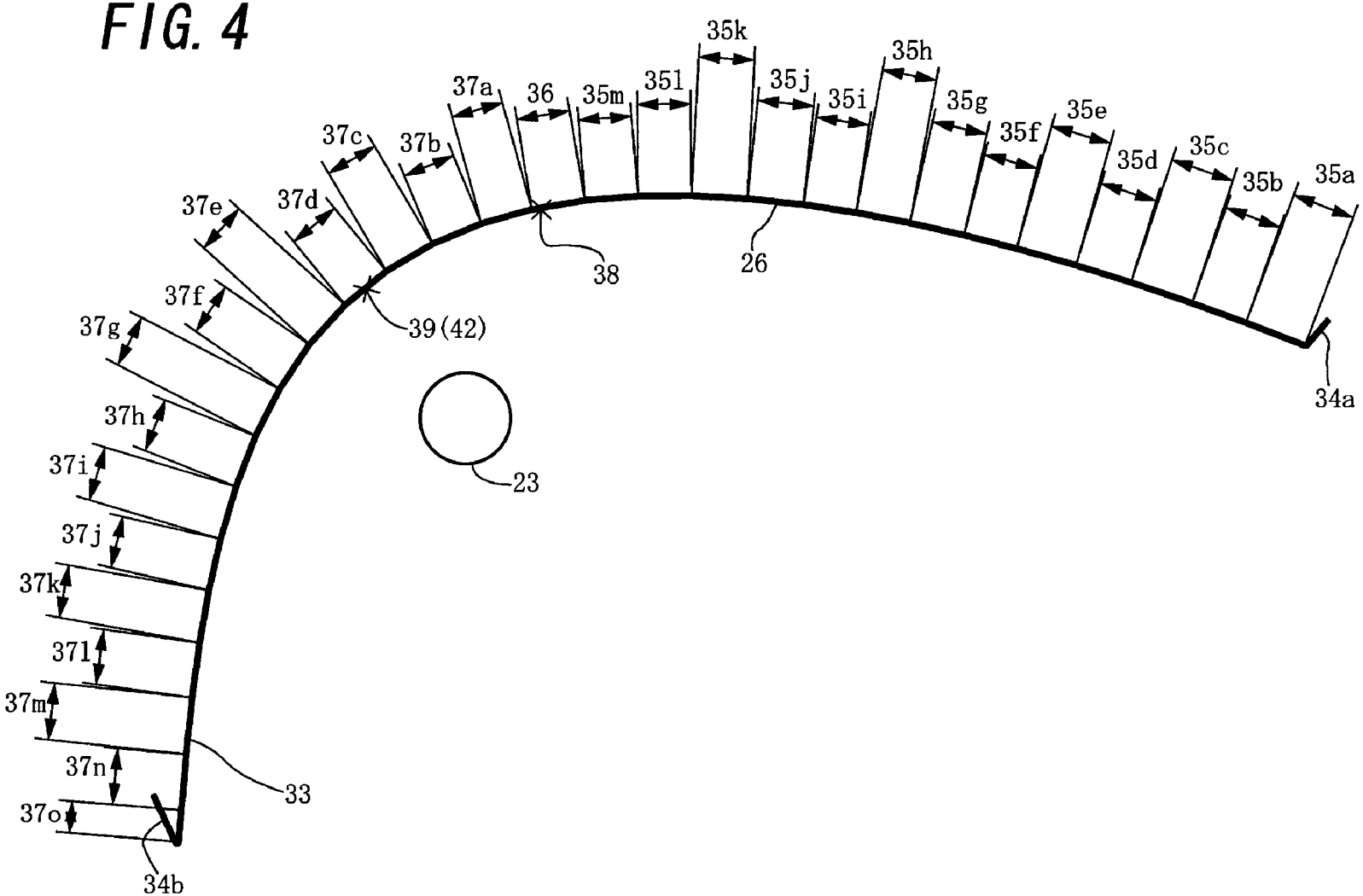
FIG. 4 is an enlarged longitudinal sectional view of the upper reflecting plate portion and rod-like heat generator of the heater shown in FIG. 3.

As shown in FIGS. 3 and 4, the reflector 24 may be formed of a substantially semiprismatic upper reflecting plate portion 26 in which a lower surface corresponding to a chord is open, and a pair of left and right reflecting plate portions 27*a* and 27*b*. Each of the left and right reflecting plate portions 27*a* and 27*b* has an attaching target portion 31 at its upper end portion. Each of the left and right reflecting plate portions 27*a* and 27*b* has, at its lower end portion, upper and lower band-like projections 32 to prevent convection heat from flowing into the hood 25. The gap between the left and right reflecting plate portions 27*a* and 27*b* may be, e.g., about 200 mm.

The inner surfaces (in other words, reflecting surfaces) of the left and right reflecting plate portions 27*a* and 27*b* shown in FIG. 3 may be substantially flat. The inner surfaces of the left and right reflecting plate portions 27*a* and 27*b* are respectively provided with sockets (not shown) for the rod-like heat generator 23. The two end portions of the rod-like heat generator 23 are attached and fixed to the pair of left and right sockets such that power can be supplied to the rod-like heat generator 23. When the reflector 24 is accommodated in the hood 25, the attaching target portions 31 of the left and right reflecting plate portions 27*a* and 27*b* are respectively attached and fixed to left and right attaching portions (not shown) provided to the hood 25. The reflector 24 (in other words, the upper reflecting plate portion 26 and left and right reflecting plate portions 27*a* and 27*b*) may be made of aluminum (for example, aluminum with a purity of 99% or more), and its reflecting surfaces may have heat ray reflectances of, e.g., about 95% or more.

As shown in FIG. 3, a distance L1 from a center 23*a* of the rod-like heat generator 23 of the heater 17 at the upper position to the upper surface of the mat 4 in the vertical direction is about 850 mm in the embodiment shown in the drawings. A distance L2 from the center 23*a* of the rod-like heat generator 23 to the center 4*a* of the mat 4 in the horizontal direction (in other words, when seen from the top) is about 665 mm in the embodiment shown in the drawings. A length L3 of the mat 4 in a longitudinal direction (in other words, a direction from the head side toward the leg side) y1 is about 635 mm in the embodiment shown in the drawings. A length L4 of the mat 4 in a lateral direction (in other words, the horizontal direction) x1 is about 375 mm in the embodiment shown in the drawings. Also, a thickness T of the mat 4 is about 20 mm in the embodiment shown in the drawings.

As shown in FIG. 3, when seen from the top, the center 23*a* of the rod-like heat generator 23 and the center 4*a* of the mat 4 are disposed substantially on one straight line in the longitudinal direction (in other words, the direction from the head side toward the leg side) y1 of the mat 4 in the embodiment shown in the drawings. An axial direction x2 of the rod-like heat generator 23 is substantially parallel to the lateral direction x1 of the mat 4. A reflecting surface 33 (see FIG. 4) as the inner surface of the upper reflecting plate portion 26 is substantially parallel to the axial direction x2 of the rod-like heat generator 23. The front portion and rear portion of the reflecting surface 33 of the upper reflecting plate portion 26 extend as they are bent substantially downward with respect to a horizontal direction y2 which is substantially perpendicular to the axial direction x2 of the rod-like heat generator 23. This inner surface 33 covers substantially the upper surface of the rod-like heat generator 23 from above.

3. Arrangement of Upper Reflecting Plate Portion

Figure 5A:
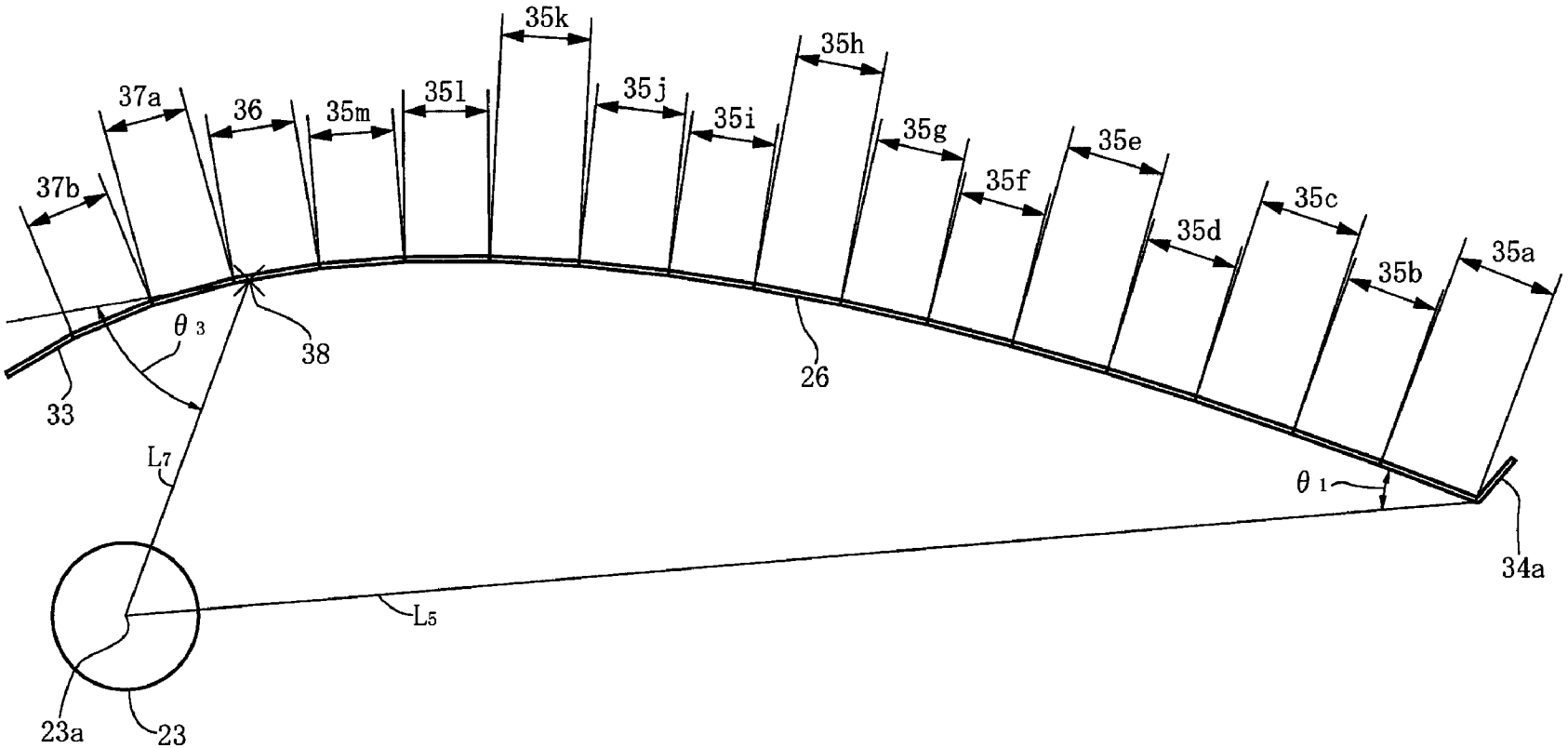
FIG. 5A is an enlarged longitudinal sectional view similar to FIG. 4, in which the rear longitudinal reflecting surface portions of the upper reflecting plate portion are omitted.
Figure 5B:
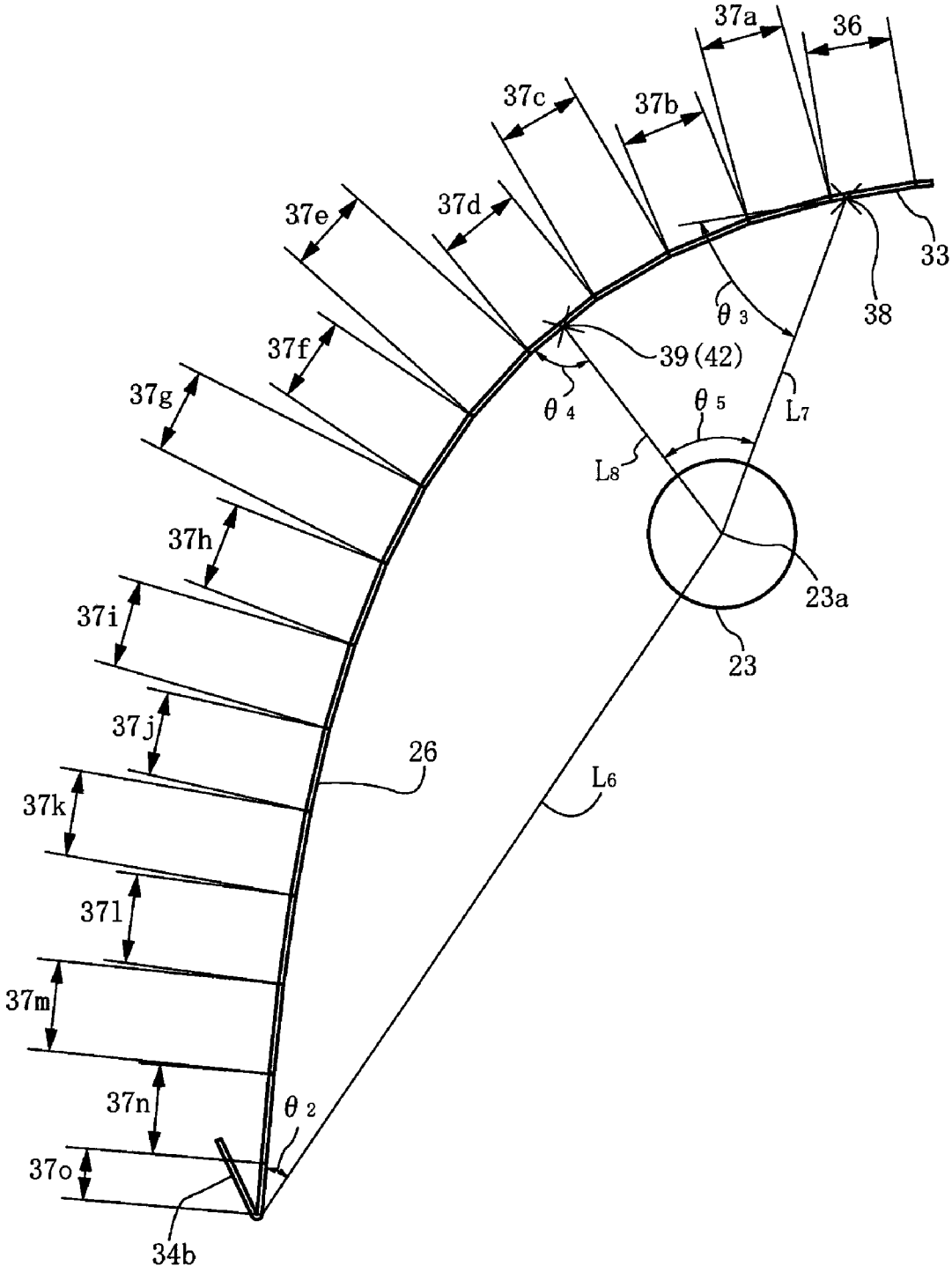
FIG. 5B is an enlarged longitudinal sectional view similar to FIG. 4, in which the front longitudinal reflecting surface portions of the upper reflecting plate portion are omitted.

As shown in FIGS. 4, 5A and 5B, the outer surface and inner surface of the upper reflecting plate portion 26 substantially form a semiprismatic shape in which a lower surface corresponding to a chord is open. For example, such upper reflecting plate portion 26 can be formed by molding a mirror-finished aluminum plate by, e.g., pressing. The front and rear end portions of the upper reflecting plate portion 26 have front and rear bends 34*a* and 34*b*, respectively, which do not serve as reflecting surfaces. The bends 34*a* and 34*b* are sufficiently bent toward the outer surface of the upper reflecting plate portion 26.

As shown in FIGS. 4, 5A and 5B, the reflecting surface 33 formed of the inner surface of the upper reflecting plate portion 26 includes 29 longitudinal reflecting surface portions 35*a* to 35*m*, 36 and 37*a* to 37*o* extending in a direction substantially parallel to the axial direction x2 of the rod-like heat generator 23. The longitudinal reflecting surface portions 35*a* to 35*m*, 36 and 37*a* to 37*o* are substantially flat and, where necessary, can be provided with small radiused portions at their boundaries.

A center 38 of the reflecting surface 33 in the back-and-forth direction, when the upper reflecting plate portion 26 is developed, is present on the longitudinal reflecting surface portion 36 (more specifically, that portion of the longitudinal reflecting surface portion 36 which is close to the longitudinal reflecting surface portion 37*a*). Hence, in the following description, the longitudinal reflecting surface portion 36 will be referred to as a central longitudinal reflecting surface portion, the longitudinal reflecting surface portions 35*a* to 35*m* will be referred to as front longitudinal reflecting surface portions, respectively, and the longitudinal reflecting surface portions 37*a* to 37*o* will be referred to as rear longitudinal reflecting surface portions, respectively. The rough width (in other words, a length in a direction substantially perpendicular to the axial direction x2 of the rod-like heat generator 23) of each of the longitudinal reflecting surface portions 35*a* to 35*m*, 36 and 37*a* to 37*o* is expressed as a width in the following Tables 1 and 2. The rough angle formed by each of the front longitudinal reflecting surface portions 35*a* to 35*m* and rear longitudinal reflecting surface portions 37*a* to 37*o* with the central longitudinal reflecting surface portion 36 is expressed as an angle in the following Tables 1 and 2. In Table 1, an angular difference indicates a rough angle formed by each of the longitudinal reflecting surface portions 35*a* to 35*m* with a corresponding one of the longitudinal reflecting surface portions 35*b* to 35*m* and 36 that immediately follows it. In Table 2, an angular difference indicates a rough angle formed by each of the longitudinal reflecting surface portions 37*a* to 37*o* with a corresponding one of the longitudinal reflecting surface portions 36 and 37*a* to 37*n* that immediately precedes it. In Table 1, reference numeral indicates that of each of the front longitudinal reflecting surface portions 35*a* to 35*m* and central longitudinal reflecting surface portion 36. In Table 2, reference numeral indicates that of each of the central longitudinal reflecting surface portion 36 and rear longitudinal reflecting surface portions 37*a* to 37*o*.

TABLE 1

| | Reference Numeral | | | | | | |
|---|---|---|---|---|---|---|---|
| | 35a | 35b | 35c | 35d | 35e | 35f | 35g |
| Width (mm) | 9.72 | 8.80 | 9.88 | 8.80 | 9.36 | 8.26 | 8.49 |
| Angle | 30° | 29° | 28° | 27° | 26° | 25° | 23° |
| Angular Difference | 1° | 1° | 1° | 1° | 1° | 2° | 2° |

| | Reference Numeral | | | | | | |
|---|---|---|---|---|---|---|---|
| | 35h | 35i | 35j | 35k | 35l | 35m | 36 |
| Width (mm) | 8.44 | 8.21 | 8.56 | 8.51 | 8.19 | 8.16 | 8.24 |
| Angle | 21° | 19° | 16° | 13° | 9° | 5° | 0° |
| Angular Difference | 2° | 3° | 3° | 4° | 4° | 5° | — |

TABLE 2

| | Reference Numeral | | | | | | | |
|---|---|---|---|---|---|---|---|---|
| | 36 | 37a | 37b | 37c | 37d | 37e | 37f | 37g |
| Width (mm) | 8.24 | 8.08 | 8.17 | 8.16 | 8.10 | 8.12 | 8.17 | 8.10 |
| Angle | 0° | 6° | 13° | 21° | 30° | 38° | 46° | 53° |
| Angular Difference | — | 6° | 7° | 8° | 9° | 8° | 8° | 7° |

| | Reference Numeral | | | | | | | |
|---|---|---|---|---|---|---|---|---|
| | 37h | 37i | 37j | 37k | 37l | 37m | 37n | 37o |
| Width (mm) | 8.31 | 8.39 | 8.04 | 8.13 | 8.52 | 8.72 | 8.59 | 4.89 |
| Angle | 59° | 64° | 68° | 71° | 73° | 74° | 75° | 76° |
| Angular Difference | 6° | 5° | 4° | 3° | 2° | 1° | 1° | 1° |

From the above Tables 1 and 2, the following items (a) to (d) are obtained concerning the reflecting surface 33 of the upper reflecting plate portion 26.

(a) Each of the longitudinal reflecting surface portions 35*a* to 35*m*, 36 and 37*a* to 37*o* has a width of about 8.04 mm to about 9.88 mm excluding the longitudinal reflecting surface portion 37*o* located at the end portion (more specifically, the rear end portion) of the reflecting surface 33 in the back-and-forth direction y2. Each of the front longitudinal reflecting surface portions 35*a* to 35*m* has a width of about 8.16 mm to about 9.88 mm excluding the reflecting surface portion 35*a* located at the front end portion of the reflecting surface 33 (this also applies even if the reflecting surface portion 35*a* is not excluded). The central longitudinal reflecting surface portion 36 has a width of about 8.24 mm. Each of the rear longitudinal reflecting surface portions 37*a* to 37*o* has a width of about 8.04 mm to about 8.72 mm excluding the reflecting surface portion 37*o* located at the rear end portion of the reflecting surface 33.

(b) The front longitudinal reflecting surface portion 35*a* located at the front end portion of the reflecting surface 33 is bent downward with respect to the central longitudinal reflecting surface portion 36 (in other words, the center 38) at angle of about 30°. The rear longitudinal reflecting surface portion 37*o* located at the rear end portion of the reflecting surface 33 is bent downward with respect to the central longitudinal reflecting surface portion 36 (in other words, the center 38) at angle of about 76°. The front longitudinal reflecting surface portion 35*a* is bent downward with respect to the rear longitudinal reflecting surface portion 37*o* at angle of about 106°.

(c) The angle formed by each of the 13 front longitudinal reflecting surface portions 35*a* to 35*m* with a corresponding one of the longitudinal reflecting surface portions 35*b* to 35*m* and 36 that immediately follows it gradually increases within a range of about 1° to about 5° from the front end portion (in other words, the longitudinal reflecting surface portion 35*a*) toward the rear end portion (in other words, the longitudinal reflecting surface portion 35*m*) of the reflecting surface 33.

(d) The angle formed by each of the 15 rear longitudinal reflecting surface portions 37*a* to 37*o* with a corresponding one of the longitudinal reflecting surface portions 36 and 37*a* to 37*n* that immediately precedes it gradually increases within a range of about 6° to about 9° from the front end portion (in other words, the longitudinal reflecting surface portion 37*a*) to a midway point (in other words, the longitudinal reflecting surface portion 37*d*), and gradually decreases within a range of about 1° to about 9° from the midway point (in other words, the longitudinal reflecting surface portion 37*d*) to the rear end portion (in other words, the longitudinal reflecting surface portion 37*o*).

The center 39 of the midway longitudinal reflecting surface portion 37*d* in the widthwise direction which is described in the item (d) is located behind the center 38 of the reflecting surface 33 by about 29.03 mm and in front of the rear end of the reflecting surface 33 by about 92.03 mm when the upper reflecting plate portion 26 is developed substantially flat (in other words, when the reflecting surface 33 is developed substantially flat). In other words, the reflecting surface 33 is bent inward along the back-and-forth direction y2 most at a region including a portion, which is in front of the rear end of the reflecting surface 33 in the back-and-forth direction y2 by about 38% the entire length of the reflecting surface 33 and behind the front end of the reflecting surface 33 in the back-and-forth direction y2 by about 62% the entire length of the reflecting surface 33, and its vicinity.

The mutual positional relationship between the reflecting surface 33 and rod-like heat generator 23 will be described with reference to FIGS. 4, 5A and 5B as in the following items (e) to (l).

(e) A distance L5 (see FIG. 5A) between the center 23*a* of the rod-like heat generator 23 and the front end of the reflecting surface 33 (in other words, the front end of the front longitudinal reflecting surface portion 35*a*) is about 129 mm. This straight line L5 forms an angle θ1 of about 25° with the front end of the front longitudinal reflecting surface portion 35*a* (in other words, the front end of the reflecting surface 33).

(f) A distance L6 (see FIG. 5B) between the center 23*a* of the rod-like heat generator 23 and the rear end of the reflecting surface 33 (in other words, the rear end of the rear longitudinal reflecting surface portion 37*o*) is about 79 mm. This straight line L6 forms an angle θ2 of about 30° with the rear end of the rear longitudinal reflecting surface portion 37*o* (in other words, the rear end of the reflecting surface 33).

(g) The angle obtained by subtracting the angle θ1 from the angle θ2 (in other words, θ2−θ1) is about 5°.

(h) A distance L7 (see FIGS. 5A and 5B) between the center 23*a* of the rod-like heat generator 23 and the center 38 of the reflecting surface 33 in the back-and-forth direction y2 is about 34 mm. At the center 38, this straight line L7 forms an angle θ3 of about 55° with the reflecting surface 33 (in other words, the central longitudinal reflecting surface portion 36).

(i) A shortest distance L8 (see FIG. 5B) between the center 23*a* of the rod-like heat generator 23 and the reflecting surface 33 is about 24 mm. At a point 42 of the shortest distance L8, this straight line L8 forms an angle θ4 of about 90° with the reflecting surface 33 (more specifically, the rear longitudinal reflecting surface portion 37*d*).

(j) The straight line L7 forms an angle θ5 of about 60° with the straight line L8.

(k) The gap between the front end and rear end of the reflecting surface 33 in the back-and-forth direction y2 is about 199 mm.

(l) The maximum depth of the reflecting surface 33 (in other words, the length of a perpendicular extending upright from a plane connecting the front end and rear end of the reflecting surface 33 toward the deepest portion of the reflecting surface 33 (in the embodiment shown in the drawings, a region including a boundary of the longitudinal reflecting surface portions 37*b* and 37*c*, and its vicinity)) is about 68 mm.

The point 42 (see FIG. 5B) of the shortest distance described in the above item (i) is present at a region including a center 39 of the midway longitudinal reflecting surface portion 37*d* (in other words, the portion where the inward bend of the reflecting surface 33 along the back-and-forth direction is maximum) described in the above item (d), and its vicinity.

4. Function and Effect of Heater

Figure 6:
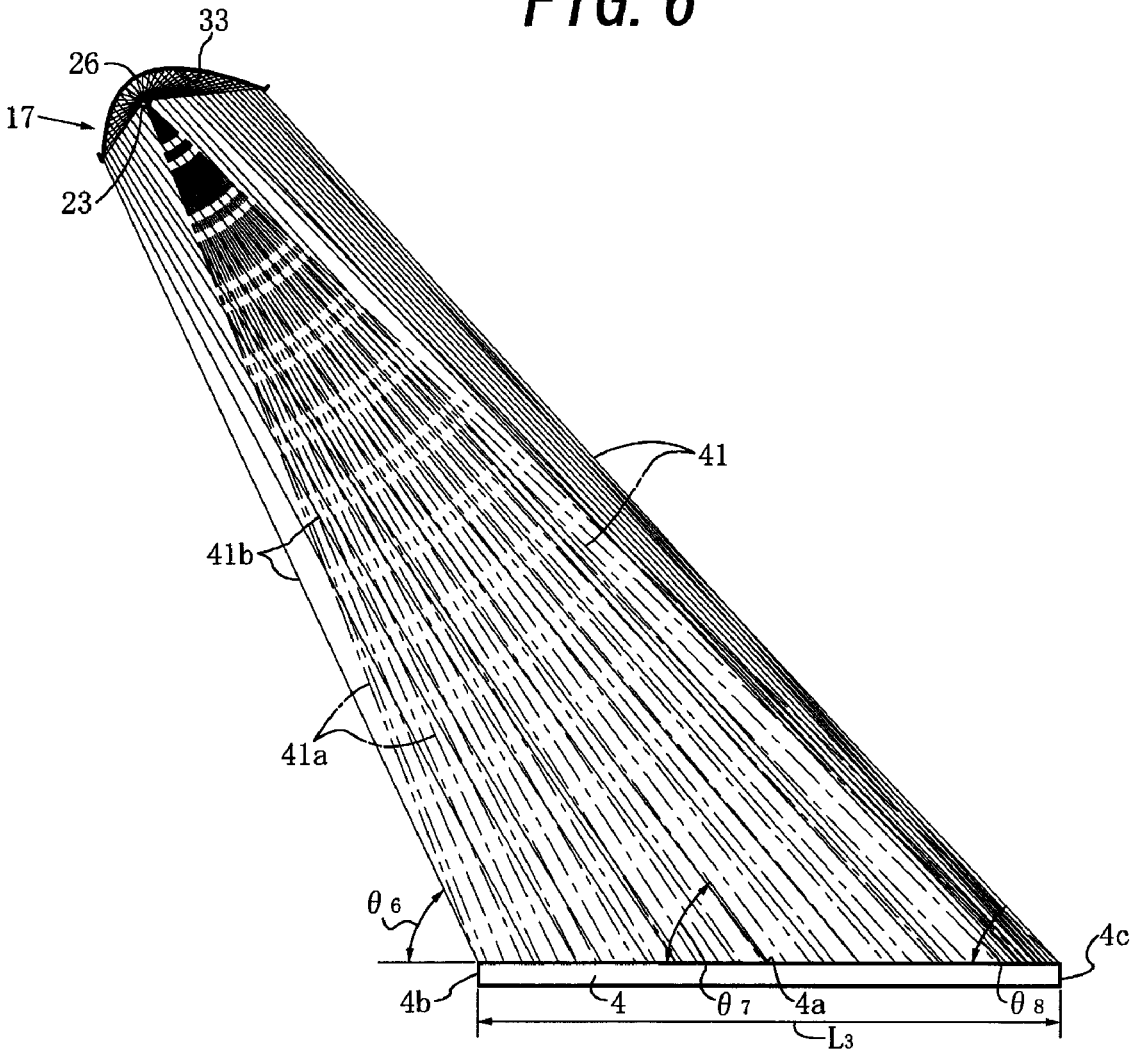
FIG. 6 is a right side view schematically showing heat rays radiated from the heater toward the mat in the incubator shown in FIG. 1.
Figure 7:
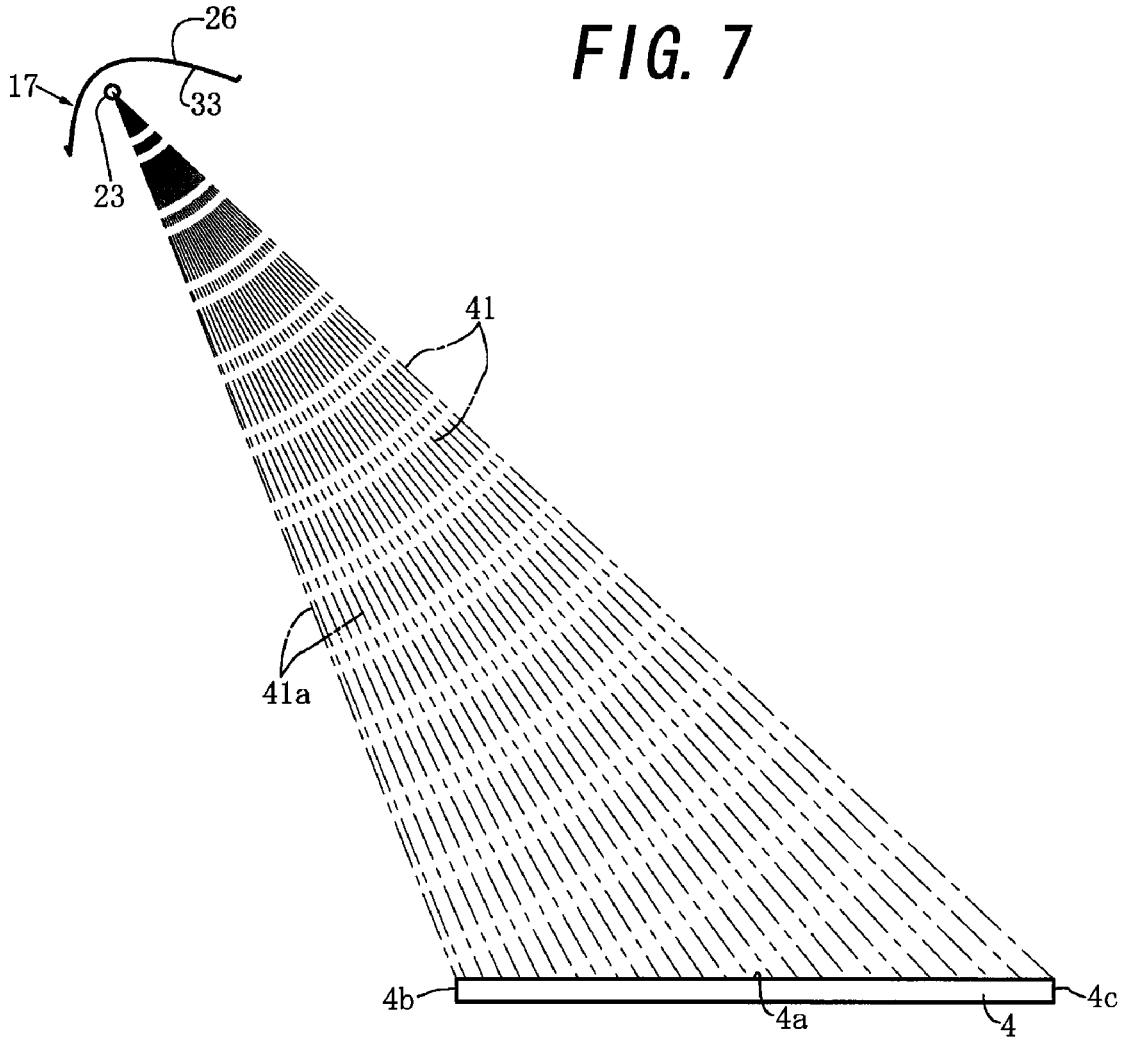
FIG. 7 is a right side view, similar to FIG. 6, schematically showing only direct heat rays directly radiated from the rod-like heater toward the mat in the incubator shown in FIG. 1.
Figure 8:
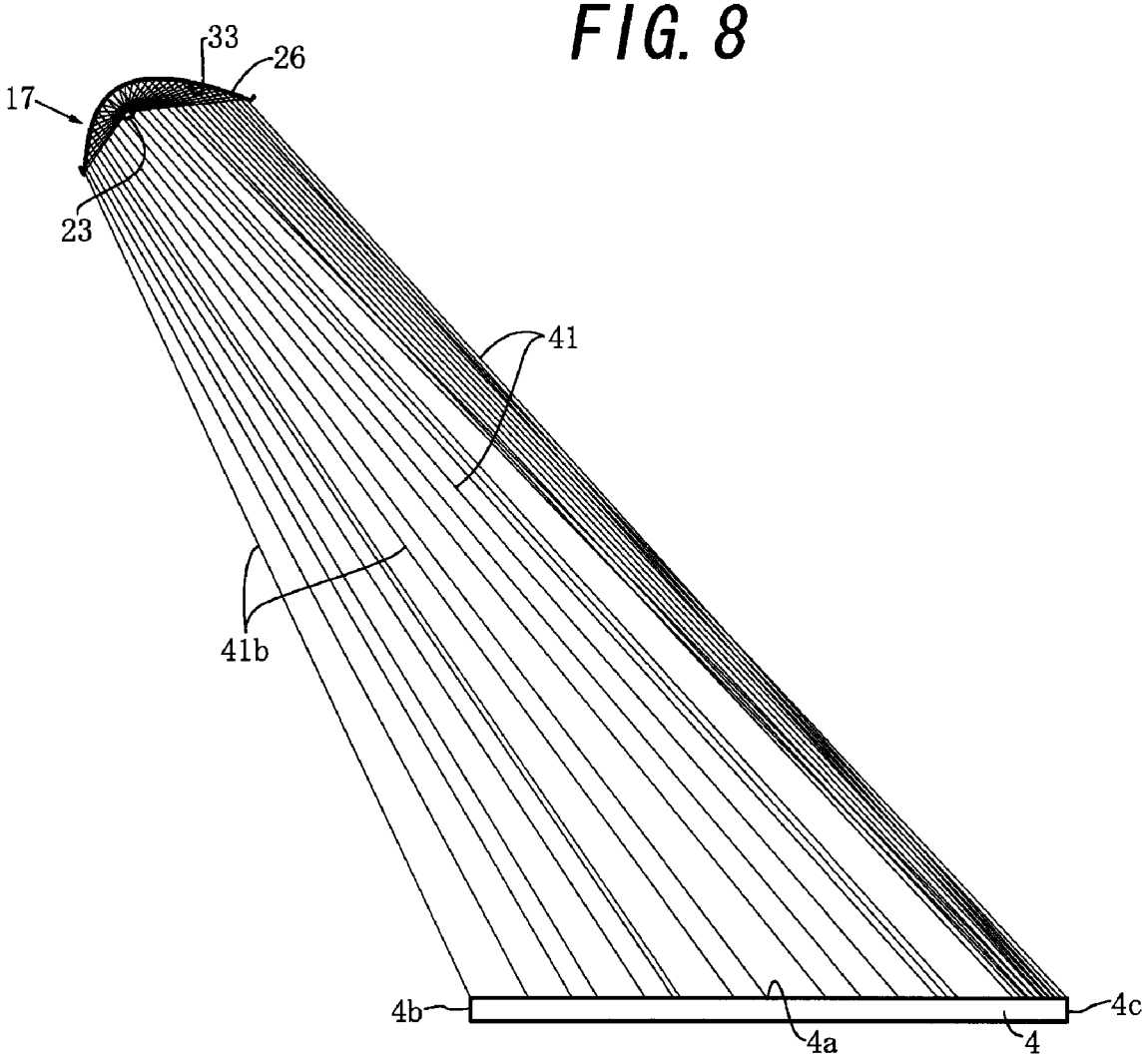
FIG. 8 is a right side view, similar to FIG. 6, schematically showing only reflected heat rays radiated from the rod-like heater, reflected by the upper reflecting plate portion and radiated toward the mat in the incubator shown in FIG. 1.

FIG. 6 shows heat rays 41 radiated from the center 23*a* of the rod-like heat generator 23 toward the upper surface of the mat 4, which are seen from the axial direction y2 of the rod-like heat generator 23. In this case, of the heat rays 41, direct heat rays 41*a* radiated directly from the center 23*a* of the rod-like heat generator 23 toward the upper surface of the mat 4 are indicated by alternate long and short dashed lines. Of the heat rays 41, reflected heat rays 41*b* radiated from the center 23*a* of the rod-like heat generator 23, reflected by the reflecting surface 33 of the upper reflecting plate portion 26 and radiated toward the upper surface of the mat 4 are indicated by solid lines. FIG. 7 is a view, similar to FIG. 6, showing only the direct heat rays 41*a*. FIG. 8 is a view, similar to FIG. 6, showing only the reflected heat rays 41*b*.

In FIG. 6, the beam of heat rays 41 forms an angle θ6 of about 66° with a head-side end 4*b* of the upper surface of the mat 4, an angle θ7 of about 55° with the center 4*a* of the upper surface of the mat 4 and an angle θ8 of about 44° with a leg-side end 4*c* of the upper surface of the mat 4. The distance from the center 23*a* of the rod-like heat generator 23 to the head-side end 4*b* of the upper surface of the mat 4 is about 100 cm. In contrast to this, the distance from the center 23*a* of the rod-like heat generator 23 to the leg-side end 4*c* of the upper surface of the mat 4 is about 130 cm. Therefore, as shown in FIG. 7, the direct heat rays 41*a* have comparatively short radiation distances and comparatively small incident angles at a region including the head-side end 4*b* of the upper surface of the mat 4 and its vicinity, medium radiation distances and incident angles at the center 4*a* of the upper surface of the mat 4, and comparatively long radiation distances and comparatively large incident angles at the leg-side end 4*c* of the upper surface of the mat 4. If the arrangement and the like of the reflector 24 are devised as shown in FIGS. 3 and 4, the reflected heat rays 41*b* are radiated in a small quantity at a region including the head-side end 4*b* of the upper surface of the mat 4 and its vicinity, in a somewhat large quantity at the center 4*a* of the upper surface of the mat 4, and in a considerably large quantity at the leg-side end 4*c* of the upper surface of the mat 4, as shown in FIG. 8. Accordingly, the upper surface of the mat 4 shown in FIG. 6 is heated substantially uniformly or almost uniformly in a portion ranging from the head-side end 4*b* to the leg-side end 4*c* via the center 4*a* in the horizontal direction y2 substantially perpendicular to the axial direction x2 of the rod-like heat generator 23.

Figure 9:
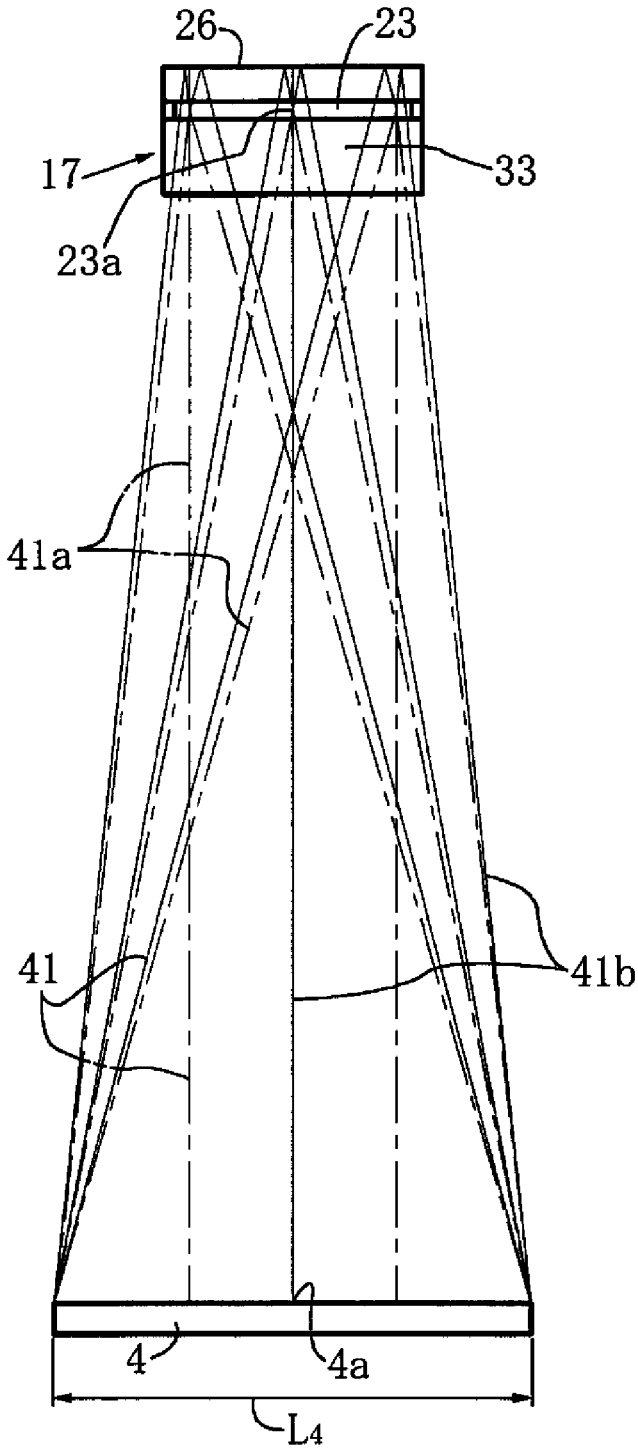
FIG. 9 is a front view schematically showing a state similar to that in FIG. 6.
Figure 10:
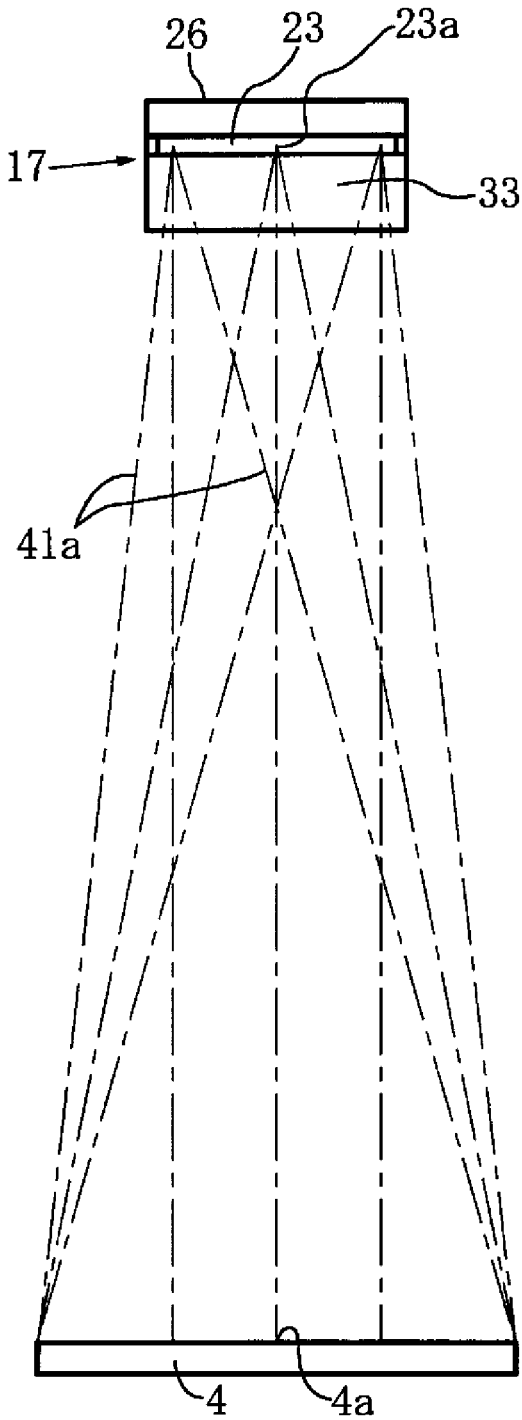
FIG. 10 is a front view schematically showing a state similar to that in FIG. 7.
Figure 11:
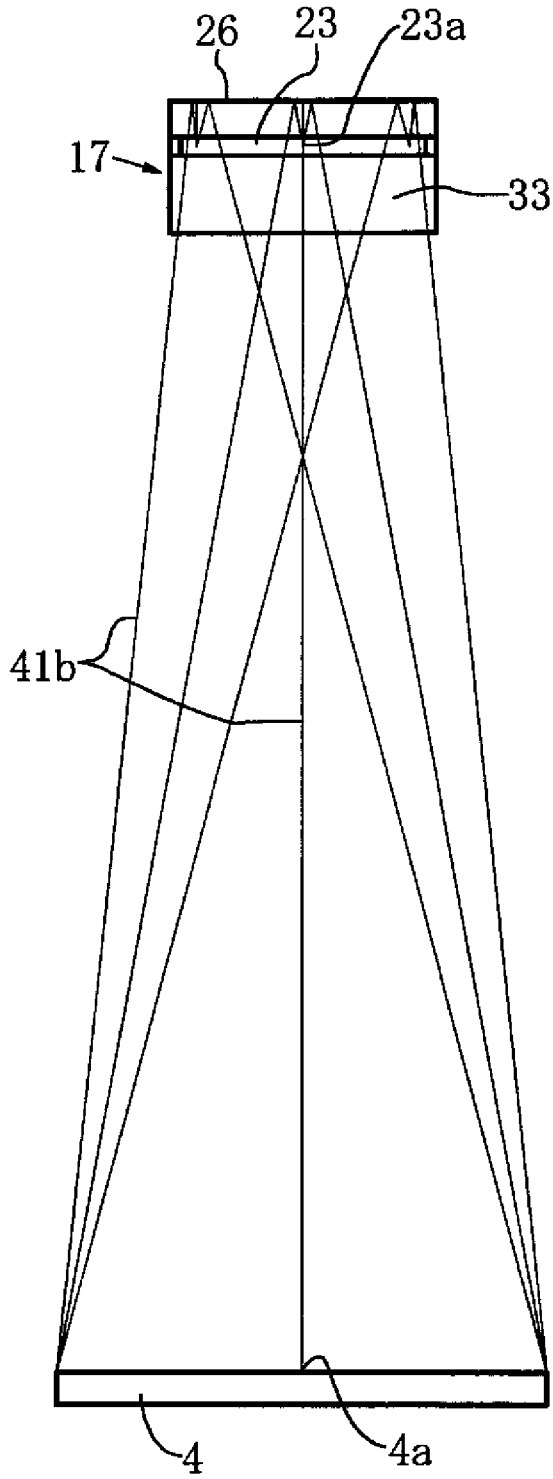
FIG. 11 is a front view schematically showing a state similar to that in FIG. 8.

FIG. 9 is a front view showing the heat rays 41 radiated from the center 23*a* and a region including the pair of left and right end portions of the rod-like heat generator 23 and their vicinities toward the upper surface of the mat 4, which are seen from the horizontal direction y2 perpendicular to the axial direction x2 of the rod-like heat generator 23. In this case as well, of the heat rays 41, the direct heat rays 41*a* radiated directly from the rod-like heat generator 23 toward the upper surface of the mat 4 are indicated by alternate long and short dashed lines. Of the heat rays 41, the reflected heat rays 41*b* radiated from the rod-like heat generator 23, reflected by the reflecting surface 33 of the upper reflecting plate portion 26, and radiated toward the upper surface of the mat 4 are indicated by solid lines. FIG. 10 is a view, similar to FIG. 9, showing only the direct heat rays 41*a*. FIG. 11 is a view, similar to FIG. 9, showing only the reflected heat rays 41*b*.

In FIG. 9, the center 23*a* of the rod-like heat generator 23 and the center 4*a* of the upper surface of the mat 4 are disposed substantially on one straight line in the vertical direction perpendicular to the axial direction x2 of the rod-like heat generator 23. The length L4 of the mat 4 in the widthwise direction x1 is about 375 mm, whereas the length of the rod-like heat generator 23 in the axial direction x2 is about 180 mm. Accordingly, the ratio of the latter length to the former length L4 is about 48%. Hence, the direct heat rays 41*a* and reflected heat rays 41*b* of the heat rays 41 are radiated substantially uniformly or almost uniformly in the widthwise direction x1 of the upper surface of the mat 4. Accordingly, the upper surface of the mat 4 shown in FIG. 9 is heated substantially uniformly or almost uniformly in a portion ranging from the left end to the right end in substantially the axial direction x2 of the rod-like heat generator 23.

As has been apparent from the above description, when the top hood 16 is at the upper position, as shown in FIG. 1, the heat rays 41 (in other words, the sum of the direct heat rays 41*a* and reflected heat rays 41*b*) from the rod-like heat generator 23 can warm the entire substantially rectangular upper surface of the mat 4 substantially uniformly or almost uniformly. More specifically, at whatever portion of the substantially rectangular upper surface of the mat 4 (in other words, heat ray radiation region) the temperature was measured, the temperature difference between the preset temperature and the measurement temperature of the heat ray radiation region was approximately 1° C. Therefore, at whatever portion of the upper surface of the mat 4 the infant may be laid, the attending personnel can perform resuscitation or various types of other treatments or medical procedures for the infant. When the top hood 16 moves downward as shown in FIG. 2 and the enclosure 3 including the top hood 16 forms a closed space above the upper surface of the mat 4, power supply to the rod-like heat generator 23 of the heater 17 staying at the upper position shown in FIG. 1 is reduced to, e.g., about ⅕ the power supplied when the top hood 16 is at the upper position shown in FIG. 1. As a result, dew condensation on the inner surface of the enclosure 3 (particularly the top hood 16) of the incubator 1 serving as a closed type incubator is prevented, and the closed space is maintained at an appropriate temperature. When the heater 17 of the incubator 1 serving as the closed type incubator moves downward to the lower position shown in FIG. 2 and thus becomes non-operable, power supply to the rod-like heat generator 23 is interrupted automatically.

Furthermore, in the embodiment shown in the drawings, as shown in FIG. 3, when seen from the top, the heater 17 is disposed at a position outside the mat 4 sufficiently spaced apart from the head-side end 4*b* of the mat 4 in the longitudinal direction y1 of the mat 4. More specifically, when seen from the top, the center 23*a* of the rod-like heat generator 23 is located at a position spaced apart from the head-side end 4*b* outward in the longitudinal direction y1 of the mat 4 by L2−(½)·L3 (namely, about 347.5 mm). As the heater 17 at the heat ray radiation position is disposed at the position outside the mat 4 spaced apart from the head-side end 4*b* of the mat 4 when seen from the top, it does not serve as an obstacle when moving the top hood 16 vertically. Also, when performing, e.g., X-ray imaging of the infant on the mat 4, the heater 17 need not be retracted to another location. Also, the head of the personnel attending to the infant on the mat 4 is least likely to block the heat rays from the heater 17. Therefore, the heater 17 can exhibit its original performance readily, and the head (particularly the back head part) of the attending personnel is least likely to be accidentally heated.

5. Modification

Having described a specific preferred embodiment of this invention with reference to the accompanying drawings, it is to be understood that the invention is not limited to that precise embodiment, and that various changes and modifications may be effected, as described in the following items (a) to (d), therein by one skilled in the art without departing from the scope or spirit of the invention as defined in the appended claims.

(a) In the embodiment shown in the drawings, the present invention is applied to the open type incubator 1 serving also as a closed type incubator. However, the present invention is also applicable to an open type incubator (a so-called infant warmer), an infant resuscitation apparatus and another infant care apparatus.

(b) In the embodiment shown in the drawings, when seen from the top, the heater 17 (in other words, the hood 25 and/or reflector 24 and/or rod-like heat generator 23) is arranged at a location outside the head-side end 4*b* of the upper surface of the mat 4 in the longitudinal direction y1 of the mat 4, as shown in FIG. 3 and FIGS. 6 to 8. In the case of an open type incubator and the like, when seen from the top, the heater 17 (particularly the reflector 24 and/or rod-like heat generator 23) may be arranged at a location covering the upper surface of the mat 4 partially or entirely. In this case, the entire heater 17 can be attached and fixed to the movable strut 22 in the state that the entire heater 17 has been slightly pivoted clockwise in FIG. 4 about the axial direction of, e.g., the rod-like heat generator 23 as the pivot center.

(c) In the embodiment shown in the drawings, when seen from the top, the horizontal direction y2 extending through the center 23*a* of the rod-like heat generator 23 and substantially perpendicular to the axial direction x2 of the rod-like heat generator 23 substantially coincides with the longitudinal direction of the mat 4 which extends through the center 4*a* of the mat 4. However, when seen from the top, the horizontal direction y2 perpendicular to the axial direction x2 of the rod-like heat generator 23 which extends through the center 23*a* of the rod-like heat generator 23 need not always substantially coincide with the longitudinal direction y1 of the mat 4 which extends through the center 4*a* of the mat 4. The horizontal direction y2 may intersect the longitudinal direction y1 to be angularly, slightly shifted from it clockwise or counterclockwise, misaligned from the longitudinal direction y1 to the left side or right side slightly to be substantially parallel to it, or angularly shifted and misaligned from it simultaneously. When the horizontal direction y2 intersects the longitudinal direction y1, when seen from the top, the horizontal direction y2 perpendicular to the axial direction x2 of the rod-like heat generator 23 which extends through the center 23*a* of the rod-like heat generator 23 preferably extends through substantially the center 4*a* of the mat 4.

(d) In the embodiment shown in the drawings, as shown in FIGS. 4, 5A and 5B, the entire reflecting surface 33 of the upper reflecting plate portion 26 is formed of the large number of substantially flat longitudinal reflecting surface portions 35*a* to 35*m*, 36 and 37*a* to 37*o*. Thus, the reflecting surface 33 is bent stepwise from its upper end to rear end to substantially surround the upper surface of the rod-like heat generator 23. However, in the present invention, the entire reflecting surface 33 of the upper reflecting plate portion 26 need not always be formed of the substantially flat longitudinal reflecting surface portions 35*a* to 35*m*, 36 and 37*a* to 37*o*, but may include a curved surface partly or entirely. In this case, the curved surface can be an envelope substantially conforming to the longitudinal reflecting surface portions 35*a* to 35*m*, 36 and 37*a* to 37*o* partly or entirely. When compared to the curved surface, the substantially flat longitudinal reflecting surface portions 35*a* to 35*m*, 36 and 37*a* to 37*o* do not easily deform by warp or the like. Thus, in general, the substantially flat longitudinal reflecting surface portions are more preferable than the curved surface.

6. Preferred Arrangements as Infant Care Apparatus

The present invention can be applied not only to the open type incubator 1 serving also as a closed type incubator, as shown in the drawings, but also to an open type incubator, an infant resuscitation apparatus and another infant care apparatus, as described in the above item 5(a). In general, preferred arrangements in applying the present invention to the infant care apparatus include those of the following items (1) to (32) from the viewpoint of practicality. An infant care apparatus to which the present invention is applied preferably includes some or all of the arrangements described in items (1) to (32).

(1) The rod-like heat generator 23 has a diameter falling within a range of 7.5 mm to 30 mm (preferably 10 mm to 22.5 mm and more preferably 12 mm to 19 mm).

(2) The rod-like heat generator 23 has a length falling within a range of 90 mm to 360 mm (preferably 120 mm to 270 mm and more preferably 145 mm to 225 mm).

(3) The gap between the left reflecting plate portion 27*a* and right reflecting plate portion 27*b* of the reflector 24 is slightly larger than the length of the rod-like heat generator 23 and falls within a range of 100 mm to 400 mm (preferably 130 mm to 300 mm and more preferably 160 mm to 250 mm).

(4) When the heater 17 is at the upper position (in other words, a normal heat ray radiation position), the distance L1 (see FIG. 3) from the center 23*a* of the rod-like heat generator 23 to the upper surface of the mat 4 in the vertical direction falls within a range of 570 mm to 1,270 mm (preferably 640 mm to 1,130 mm and more preferably 680 mm to 1,060 mm).

(5) When the heater 17 is at the heat ray radiation position, the distance L2 (see FIG. 3) from the center 23*a* of the rod-like heat generator 23 to the center 4*a* of the mat 4, when seen from the top, falls within a range of 440 mm to 1,000 mm (preferably 500 mm to 880 mm and more preferably 530 mm to 830 mm).

(6) The length L3 of the mat 4 in the longitudinal direction y1 falls within a range of 420 mm to 960 mm (preferably 480 mm to 840 mm and more preferably 500 mm to 800 mm).

(7) The length L4 of the mat 4 in the lateral direction x1 falls within a range of 250 mm to 560 mm (preferably 280 mm to 500 mm and more preferably 300 mm to 470 mm).

(8) The reflecting surface 33 of the upper reflecting plate portion 26 of the reflector 24 is formed of the large number of substantially flat longitudinal reflecting surface portions 35*a* to 35*m*, 36 and 37*a* to 37*o* extending in a direction substantially parallel to the axial direction x2 of the rod-like heat generator 23, and the number of longitudinal reflecting surface portions 35*a* to 35*m*, 36 and 37*a* to 37*o* falls within a range of 18 to 44 (preferably 21 to 39 and more preferably 24 to 36).

(9) The width of each of the large number of longitudinal reflecting surface portions 35*a* to 35*m*, 36 and 37*a* to 37*o* described in the above item (8) falls within a range of 5.4 mm to 14.8 mm (preferably 6.0 mm to 13.2 mm and more preferably 6.4 mm to 12.4 mm) excluding the longitudinal reflecting surface portions (the longitudinal reflecting surface portions 35*a* and 37*o* in the embodiment shown in the drawings) located at the end portions of the reflecting surface 33 in the back-and-forth direction y2.

(10) The angle at which the front end of the reflecting surface 33 is bent downward with respect to the center 38 of the reflecting surface 33, which is developed substantially flat, of the upper reflecting plate portion 26 in the back-and-forth direction y2 (more specifically, the angle formed by the central longitudinal reflecting surface portion 36 and the front longitudinal reflecting surface portion 35*a*) falls within a range of 20° to 45° (preferably 22.5° to 40° and more preferably 24° to 36°).

(11) Degree of change of the angle at which the reflecting surface 33 is bent downward with respect to the center 38 described in the above item (10) from the center 38 toward the front end of the reflecting surface 33 decreases stepwise and/or continuously from the center 38 toward the front end of the reflecting surface 33.

(12) When at least two adjacent ones of the substantially flat longitudinal reflecting surface portions 35*a* to 35*m* are included between the center 38 described in the above item (10) and the front end of the reflecting surface 33 (including a case in which, of the reflecting surface 33, the front side in front of the center 38 includes only substantially flat longitudinal reflecting surface portions 35*a* to 35*m*), the angle formed by each longitudinal reflecting surface portion with the front or rear adjacent longitudinal reflecting surface portion falls within a range of 0.5° to 7.5° (preferably 0.75° to 6.75° and more preferably 0.8° to 6°).

(13) The angle at which the rear end of the reflecting surface 33 is bent downward with respect to the center 38 described in the above item (10) (more specifically, the angle formed by the central longitudinal reflecting surface portion 36 and the rear longitudinal reflecting surface portion 37*o*) falls within a range of 50° to 115° (preferably 55° to 100° and more preferably 60° to 95°)

(14) Degree of change of the angle at which the reflecting surface 33 is bent downward with respect to the center 38 described in the above item (10) from the center 38 toward the rear end of the reflecting surface 33 increases stepwise and/or continuously until a midway portion (more particularly, the longitudinal reflecting surface portion 37*d*), and decreases stepwise and/or continuously from the midway portion.

(15) When at least two adjacent ones of the substantially flat longitudinal reflecting surface portions 37*a* to 37*o* are included between the center 38 described in the above item (10) and the rear end of the reflecting surface 33 (including a case in which, of the reflecting surface 33, the rear side in rear of the center 38 includes only substantially flat longitudinal reflecting surface portions), the angle formed by each longitudinal reflecting surface portion with the front or rear adjacent longitudinal reflecting surface portion falls within a range of 0.5° to 13.5° (preferably 0.7° to 12° and more preferably 0.8° to 11.5°).

(16) The midway portion is located within a range of 28% to 50% (preferably 30% to 47.5% and more preferably 32% to 45%) of the entire length of the reflecting surface 33, which is developed substantially flat, in the back-and-forth direction y2, from the rear end of the reflecting surface 33 (in other words, when the entire length is defined as L9 (not shown), the midway portion is located within a range of 0.28×L9 to 0.50×L9 (preferably a range of 0.3×L9 to 0.475×L9 and more preferably 0.32×L9 to 0.45×L9) from the rear end of the reflecting surface 33).

(17) The angle at which rear end of the reflecting surface 33 is bent downward with respect to the front end of the reflecting surface 33 falls within a range of 70° to 160° (preferably 80° to 140° and more preferably 85° to 130°).

(18) The angle obtained by subtracting the angle described in the above item (10) from the angle descried in the above item (13) falls within a range of 30° to 70° (preferably 35° to 60° and more preferably 36° to 58°).

(19) The distance L5 (see FIG. 5A) between the center 23*a* of the rod-like heat generator 23 and the front end of the reflecting surface 33 falls within a range of 86 mm to 190 mm (preferably 96 mm to 172 mm and more preferably 104 mm to 160 mm).

(20) The angle θ1 (see FIG. 5A) formed by the line segment L5, connecting the center 23*a* of the rod-like heat generator 23 and the front end of the reflecting surface 33 in the back-and-forth direction y2, when seen from the top, with the front end of the reflecting surface 33 falls within a range of 16° to 38° (preferably 18° to 34° and more preferably 20° to 30°).

(21) The distance L6 (see FIG. 5B) between the center 23*a* of the rod-like heat generator 23 and the rear end of the reflecting surface 33 falls within a range of 52 mm to 120 mm (preferably 60 mm to 106 mm and more preferably 64 mm to 98 mm).

(22) The angle θ2 (see FIG. 5B) formed by the line segment L6, connecting the center 23*a* of the rod-like heat generator 23 and the rear end of the reflecting surface 33 in the back-and-forth direction y2, when seen from the top, with the rear end of the reflecting surface 33 falls within a range of 20° to 45° (preferably 22.5° to 40° and more preferably 24° to 36°)

(23) The distance L7 (see FIGS. 5A and 5B) between the center 23*a* of the rod-like heat generator 23 and the center 38 of the reflecting surface 33 in the back-and-forth direction y2 falls within a range of 22 mm to 55 mm (preferably 25 mm to 45 mm and more preferably 27.5 mm to 42 mm).

(24) The angle θ3 formed at the center 38 by the line segment L7, connecting the center 23*a* of the rod-like heat generator 23 and the center 38 of the reflecting surface 33 in the back-and-forth direction y2, with the reflecting surface 33 falls within a range of 36° to 82° (preferably 42° to 72° and more preferably 44° to 68°).

(25) The shortest distance L8 (see FIG. 5B) between the center 23*a* of the rod-like heat generator 23 and the reflecting surface 33 falls within a range of 16 mm to 36 mm (preferably 18 mm to 32 mm and more preferably 19 mm to 30 mm).

(26) The angle θ4 (see FIG. 5B) formed by the line segment L8, connecting the center 23*a* of the rod-like heat generator 23 and the reflecting surface 33 with a shortest distance, with the reflecting surface 33 at the point 42 of the shortest distance falls within a range of 60° to 135° (preferably 68° to 120° and more preferably 72° to 110°).

(27) The angle θ5 formed by the line segment L7 described in the above item (23) and the line segment L8 described in the above item (25) falls within a range of 40° to 90° (preferably 45° to 75° and more preferably 50° to 70°).

(28) The angle obtained by subtracting the angle θ1 described in the above item (20) from the angle θ2 described in the above item (22) (in other words, θ2−θ1) falls within a range of 3.3° to 7.5° (preferably 3.75° to 6.67° and more preferably 4° to 6.25°).

(29) When the center 23*a* of the rod-like heat generator 23 is misaligned from the center 4*a* of the mat 4 in the transverse direction x1 of the mat 4, when seen from the top, as described in the above item 5(c), the misalignment gap falls within a range of 0 mm to 300 mm (preferably 0 mm to 265 mm and more preferably 0 mm to 250 mm).

(30) When the direction y2 perpendicular to the axial direction x2 of the rod-like heat generator 23 is angularly displaced when seen from the top, as described in the above item 5(c), the angular displacement falls within a range of 0° to 30° (preferably 0° to 20° and more preferably 0° to 10°).

(31) The gap between the front end and rear end of the reflecting surface 33 in the back-and-forth direction y2 falls within a range of 130 mm to 300 mm (preferably 150 mm to 265 mm and more preferably 160 mm to 250 mm).

(32) The maximum depth of the reflecting surface 33 falls within a range of 45 mm to 100 mm (preferably 50 mm to 90 mm and more preferably 55 mm to 85 mm).

The invention claimed is:

1. An infant care apparatus including:

a mat to lay an infant thereon, and a heater capable of radiating heat rays toward an upper surface of said mat, wherein said heater includes a substantially rod-like heat generator, and a reflector including an upper reflecting plate portion covering the rod-like heat generator substantially from above;

wherein the rod-like heat generator includes a center obliquely above a center of the upper surface of said mat;

wherein the upper reflecting plate portion includes an inner surface that forms a reflecting surface extending substantially parallel to an axial direction of the rod-like heat generator, wherein the reflecting surface comprises:

a rear end on a side opposite to the center of said mat when seen from the top;

a front end opposite to the rear end;

a center in a rear end-to-front end direction of the reflecting surface, wherein a distance along the reflecting surface from the center to the rear end is equal to a distance along the reflecting surface from the center to the front end;

a first angle at which the rear end of the reflecting surface is bent downward in a direction perpendicular to the axial direction with respect to the center of the reflecting surface, wherein the first angle falls within a range of 60° to 95°;

a second angle at which the front end of the reflecting surface is bent downward with respect to the center of the reflecting surface, wherein the second angle is smaller than the first angle and falls within a range of 24° to 36°;

a third angle at which the rear end of the reflecting surface is bent downward with respect to the front end of the reflecting surface falls within a range of 85° to 130°; and a fourth angle obtained by subtracting the second angle from the first angle falls within a range of 36° to 58°;

wherein said heater is arranged at a heat ray radiation position, said heat ray position being spaced apart from a heat-side end of said mat when seen from the top, wherein a distance from the center of the rod-like heat generator to the center of said mat, when seen from the top, falls within a range of 530 mm to 830 mm when said heater is at said heat ray radiation position.

2. An apparatus according to claim 1, wherein the infant care apparatus comprises an open type incubator serving also as a closed type incubator.

3. An apparatus according to claims 1, wherein the upper surface of said mat is substantially rectangular.

4. An apparatus according to claim 1, wherein each of said mat and said heater is supported by a common frame directly or indirectly.

5. An apparatus according to claim 1, wherein:

the reflecting surface comprises a plurality of substantially flat reflecting surface portions which extend longitudinally substantially along the axial direction of the rod-like heat generator, and the plurality of longitudinal reflecting surface portions line up sequentially to be adjacent to each other in the rear end-to-front end direction of the reflecting surface.

6. An apparatus according to claim 5, wherein the number of the plurality of longitudinal reflecting surface portions falls within a range of 18 to 44.

7. An apparatus according to claim 5, wherein the number of the plurality of longitudinal reflecting surface portions falls within a range of 21 to 39.

8. An apparatus according to claim 5, wherein the number of the plurality of longitudinal reflecting surface portions falls within a range of 24 to 36.

9. An apparatus according to claim 5, wherein each of the plurality of longitudinal reflecting surface portions has a width that falls within a range of 5.4 mm to 14.8 mm excluding the longitudinal reflecting surface portion located at the rear end of the reflecting surface.

10. An apparatus according to claim 5, wherein each of the plurality of longitudinal reflecting surface portions has a width that falls within a range of 6.0 mm to 13.2 mm excluding the longitudinal reflecting surface portion located at the rear end of the reflecting surface.

11. An apparatus according to claim 5, wherein each of the plurality of longitudinal reflecting surface portions has a width that falls within a range of 6.4 mm to 12.4 mm excluding the longitudinal reflecting surface portion located at the rear end of the reflecting surface.

12. An apparatus according to claims 5, wherein an angle formed by each of the longitudinal reflecting surface portions with one of the front and rear adjacent ones of the longitudinal reflecting surface portions falls within a range of 0.5° to 13.5°.

13. An apparatus according to claims 5, wherein an angle formed by each of the longitudinal reflecting surface portions with one of the front and rear adjacent ones of the longitudinal reflecting surface portions falls within a range of 0.7° to 12°.

14. An apparatus according to claims 5, wherein an angle formed by each of the longitudinal reflecting surface portions with one of the front and rear adjacent ones of the longitudinal reflecting surface portions falls within a range of 0.8° to 11.5°.

15. An apparatus according to claim 1, further comprising:

a fifth angle formed by a first line segment with the front end of the reflecting surface falling within a range of 16° to 38°, wherein the first line segment connects the center of the rod-like heat generator and the front end of the reflecting surface a sixth angle formed by a second line segment with the rear end of the reflecting surface falling within a range of 20° to 45°, wherein the second line segment connects the center of the rod-like heat generator and the rear end of the reflecting surface and an angle obtained by subtracting the fifth angle from the sixth angle falls within a range of 3.3° to 7.5°.

16. An apparatus according to claim 1, further comprising:

a fifth angle formed by a first line segment with the front end of the reflecting surface falling within a range of 18° to 34°, wherein the first line segment connects the center of the rod-like heat generator and the front end of the reflecting surface, a sixth angle formed by a second line segment with the rear end of the reflecting surface falling within a range of 22.5° to 40°, wherein the second line segment connects, the center of the rod-like heat generator and the rear end of the reflecting surface, and an angle obtained by subtracting the fifth angle from the sixth angle falls within a range of 3.75° to 6.67°.

17. An apparatus according to claim 1, further comprising:

a fifth angle formed by a first line segment with the front end of the reflecting surface falling within a range of 20° to 30°, wherein the first line segment connects the center of the rod-like heat generator and the front end of the reflecting surface in the back-and-forth direction with the front end of the reflecting surface falls within a range of 20° to 30°, a sixth angle formed by a second line segment with the rear end of the reflecting surface falling within a range of 24° to 36°, wherein the second line segment connects, the center of the rod-like heat generator and the rear end of the reflecting surface, and an angle obtained by subtracting the fifth angle from the sixth angle falls within a range of 4° to 6.25°.

18. An apparatus according to claim 1, wherein a horizontal direction extending through the center of the rod-like heat generator and substantially perpendicular to the axial direction of the rod-like heat generator extends substantially through the center of said mat when seen from the top.

19. An apparatus according to claim 1, wherein:

a degree of change of the angle at which the reflecting surface is bent downward with respect to the center of the reflecting surface from the center of the reflecting surface toward the front end of the reflecting surface decreases stepwise and/or continuously from the center of the reflecting surface toward the front end of the reflecting surface, and a degree of change of the angle at which the reflecting surface is bent downward with respect to the center of the reflecting surface from the center of the reflecting surface toward the rear end of the reflecting surface increases stepwise and/or continuously until a midway portion, and decreases stepwise and/or continuously from the midway portion.

20. An apparatus according to claim 1, wherein:

a degree of change of the angle at which the reflecting surface is bent downward with respect to the center of the reflecting surface from the center of the reflecting surface toward the front end of the reflecting surface decreases stepwise from the center of the reflecting surface toward the front end of the reflecting surface, and a degree of change of the angle at which the reflecting surface is bent downward with respect to the center of the reflecting surface from the center of the reflecting surface toward the rear end of the reflecting surface increases stepwise until a midway portion, and decreases stepwise from the midway portion.

* * * * *